US010358835B2

(12) United States Patent
Allen et al.

(10) Patent No.: US 10,358,835 B2
(45) **Date of Patent: *Jul. 23, 2019**

(54) FALL PROTECTION ANCHOR

(71) Applicants: Darrell Allen, Agoura Hills, CA (US); Gary Hardy, Santa Barbara, CA (US)

(72) Inventors: Darrell Allen, Agoura Hills, CA (US); Gary Hardy, Santa Barbara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/105,870

(22) Filed: Aug. 20, 2018

(65) Prior Publication Data

US 2018/0363310 A1 Dec. 20, 2018

Related U.S. Application Data

(63) Continuation of application No. 15/805,008, filed on Nov. 6, 2017, now Pat. No. 10,053,878.

(60) Provisional application No. 62/415,685, filed on Nov. 1, 2016.

(51) Int. Cl.
*E04G 21/32* (2006.01)
*A62B 35/00* (2006.01)

(52) U.S. Cl.
CPC ..... *E04G 21/3214* (2013.01); *A62B 35/0068* (2013.01); *E04G 21/328* (2013.01)

(58) Field of Classification Search
CPC ..... E04G 21/3214; E04G 21/328; A62B 35/0068
See application file for complete search history.

(56) References Cited

U.S. PATENT DOCUMENTS

| | | | |
|---|---|---|---|
| 3,521,537 | A | 7/1970 | Forni et al. |
| 3,880,405 | A | 4/1975 | Brueske |
| 4,015,827 | A | 4/1977 | Brand |
| 4,037,824 | A | 7/1977 | Whitmer |
| 4,129,197 | A | 12/1978 | Preston |
| 4,171,032 | A | 10/1979 | Woolslayer et al. |
| 4,480,819 | A | 11/1984 | Lopez |
| 4,520,898 | A | 6/1985 | Allemane |
| 4,607,724 | A | 8/1986 | Hillberg |
| 4,616,734 | A | 10/1986 | Phelps et al. |
| 4,809,468 | A | 3/1989 | Bareiss |
| 4,830,341 | A | 5/1989 | Arteau et al. |
| 4,893,736 | A | 1/1990 | Naig |
| 4,932,185 | A | 6/1990 | Lebel |
| 5,011,106 | A | 4/1991 | Cody |
| 5,054,576 | A | 10/1991 | Glynn |
| 5,143,170 | A | 9/1992 | Hunt et al. |
| 5,248,021 | A | 9/1993 | Nichols |
| 5,282,597 | A | 2/1994 | Babcock |
| 5,287,944 | A | 2/1994 | Woodyard |
| 5,320,193 | A | 6/1994 | Bongiovanni et al. |
| 5,346,036 | A | 9/1994 | Arisman et al. |

(Continued)

*Primary Examiner* — James M Ference
(74) *Attorney, Agent, or Firm* — Cislo & Thomas, LLP

(57) ABSTRACT

A rooftop fall protection anchor that comprises a plate, an anchor connection coupled with a first side of the plate, and at least one member on a second side of the plate, the member being substantially perpendicular and inboard of the plate's perimeter. The plate and/or member(s) may have holes to accommodate fasteners. The anchor connection may have at least one opening to attach a connection device of a personal fall arrest system (PFAS). The anchor connection may be coupled to the plate by a post.

12 Claims, 5 Drawing Sheets

(56) References Cited

U.S. PATENT DOCUMENTS

| | | | |
|---|---|---|---|
| 5,398,777 | A | 3/1995 | Ouellette et al. |
| 5,454,197 | A | 10/1995 | Horrigan |
| 5,465,533 | A | 11/1995 | Rummo, Jr. et al. |
| 5,553,685 | A | 9/1996 | Cook |
| 5,727,646 | A | 3/1998 | Gray |
| 5,730,245 | A | 3/1998 | Conway |
| 5,730,407 | A | 3/1998 | Ostrobrod |
| 5,829,203 | A | 11/1998 | Ealer, Sr. |
| 5,850,889 | A | 12/1998 | Rexroad et al. |
| 5,941,024 | A | 8/1999 | Journault |
| 5,971,668 | A | 10/1999 | Miller |
| 6,015,139 | A | 1/2000 | Weber |
| 6,173,809 | B1 | 1/2001 | Cole et al. |
| 6,253,875 | B1 | 7/2001 | Trindade et al. |
| 6,520,290 | B1 | 2/2003 | Carter |
| 6,640,495 | B1 | 11/2003 | McKernan |
| 6,668,509 | B1 | 12/2003 | Krebs |
| 6,672,020 | B1 | 1/2004 | Cermola et al. |
| 6,691,826 | B1 | 2/2004 | Dean |
| 6,729,083 | B1 | 5/2004 | Soyko |
| 6,786,020 | B2 | 9/2004 | Poldmaa |
| 6,868,647 | B2 | 3/2005 | Poldmaa |
| 6,966,531 | B2 | 11/2005 | Curtin |
| 7,048,090 | B2 | 5/2006 | Dean et al. |
| 7,063,186 | B1 | 6/2006 | Granke |
| 7,163,083 | B2 | 1/2007 | Argoud |
| 7,207,414 | B2 | 4/2007 | Luke et al. |
| 7,380,373 | B2 | 6/2008 | Crookston |
| 7,528,690 | B2 | 5/2009 | Christmann et al. |
| 7,802,773 | B2 | 9/2010 | Murphy |
| 7,832,153 | B2 | 11/2010 | Crookston |
| 7,861,485 | B1 | 1/2011 | Wentworth et al. |
| 8,025,125 | B2 | 9/2011 | Vetesnik et al. |
| 8,028,477 | B2 | 10/2011 | Crookston |
| 8,056,237 | B1 | 11/2011 | Candler et al. |
| 8,448,745 | B2 | 5/2013 | Crookston |
| 8,448,923 | B1 | 5/2013 | Schad et al. |
| 9,145,705 | B2 | 9/2015 | Herman |
| 2001/0032435 | A1 | 10/2001 | Austin |
| 2002/0079164 | A1 | 6/2002 | Choate |
| 2002/0100636 | A1 | 8/2002 | Cole |
| 2002/0124786 | A1 | 9/2002 | Perkins |
| 2002/0139063 | A1 | 10/2002 | Crane |
| 2003/0006094 | A1 | 1/2003 | Cole |
| 2003/0051429 | A1 | 3/2003 | Hovenier |
| 2004/0010993 | A1 | 1/2004 | Meadowcroft |
| 2004/0041141 | A1 | 3/2004 | Cannon |
| 2004/0154241 | A1 | 8/2004 | Joyce et al. |
| 2004/0173405 | A1 | 9/2004 | Bove |
| 2004/0195041 | A1 | 10/2004 | Vetesnik |
| 2004/0256176 | A1 | 12/2004 | Argoud |
| 2005/0006634 | A1 | 1/2005 | Cuccurullo |
| 2005/0098381 | A1 | 5/2005 | Flaherty |
| 2005/0189171 | A1 | 9/2005 | Bos |
| 2006/0145131 | A1 | 7/2006 | Purvis |
| 2006/0156645 | A1 | 7/2006 | Munday et al. |
| 2006/0289233 | A1 | 12/2006 | Flaherty |
| 2008/0110117 | A1 | 5/2008 | O'Gorman |
| 2010/0031573 | A1 | 2/2010 | Whiting et al. |
| 2010/0032235 | A1 | 2/2010 | Barendregt |
| 2010/0147624 | A1 | 6/2010 | Caylor et al. |
| 2010/0243837 | A1 | 9/2010 | Cox |
| 2010/0326769 | A1 | 12/2010 | Cuccurullo et al. |
| 2011/0083376 | A1 | 4/2011 | Cuccurullo |
| 2012/0073900 | A1 | 3/2012 | Cruz |
| 2012/0186906 | A1 | 7/2012 | Chilton |
| 2012/0216464 | A1 | 8/2012 | Bonapace |
| 2014/0123568 | A1 | 5/2014 | Nurdogan |
| 2014/0224579 | A1 | 8/2014 | Balascak |
| 2014/0339487 | A1 | 11/2014 | Robinson |
| 2014/0346312 | A1 | 11/2014 | Small |
| 2014/0373360 | A1 | 12/2014 | Candler et al. |
| 2015/0075107 | A1 | 3/2015 | Wert et al. |
| 2015/0107184 | A1 | 4/2015 | Nichols, Jr. |
| 2015/0121773 | A1 | 5/2015 | Mills et al. |
| 2015/0275533 | A1 | 10/2015 | Allen et al. |
| 2016/0059054 | A1 | 3/2016 | Csizmadia |
| 2018/0119439 | A1* | 5/2018 | Allen ..... E04G 21/328 |

* cited by examiner

FALL PROTECTION ANCHOR

CROSS-REFERENCE TO RELATED APPLICATION

This patent application is a continuation of U.S. patent application Ser. No. 15/805,008, entitled "Fall Protection Anchor," and filed Nov. 6, 2017, which claims the benefit of U.S. Provisional Patent Application Ser. No. 62/415,685, entitled "Fall Protection Anchor," filed Nov. 1, 2016, which applications are incorporated in their entirety here by this reference.

TECHNICAL FIELD

The present invention relates to a rooftop fall protection anchor and, more particularly, to a novel fall protection anchor that can be coupled with a personal fall arrest device at or near the rooftop of a building.

BACKGROUND

Modern safety standards often require workers on rooftops to employ fall protection systems to guard against fall-related injuries and death. For workers on buildings that are under construction, as well as completed buildings, it may be desirable to use a personal fall arrest system ("PFAS"), such as that specified in the United States Code of Federal Regulations (29 C.F.R. § 1926.502(d)). A PFAS typically comprises a body support (safety harness for the worker), an anchor that is securely fastened to the building structure, and a connector between the anchor and the harness. The connector is usually a fabric strap, which in some systems is mounted on a self-retracting reel that can lock if a fall is detected. In other systems the connector may be a shock-absorbing lanyard. The anchor must be securely attached to the building in such a manner that it will withstand the forces of a falling worker. If more than one anchor is placed on a roof, a horizontal lifeline (cable or otherwise) can be attached to or run through one or more anchors, and the connector may be attached to the horizontal lifeline to give the workers more maneuverability along the horizontal lifeline.

Most anchors are geared towards metal-framed buildings, attaching to metal framing members or a concrete deck. In wood-framing applications, the anchors are most often attached to the top of the wooden rooftop sheathing (⅝-inch or 16 mm plywood or the like), or attached to a single framing member through the sheathing. In either application, the fasteners are usually oriented in the same direction, which could in extreme circumstances unduly stress the roof, the framing member, or even cause the fasteners to detach. These applications typically rely on the integrity of the sheathing or the single framing member. What is needed is a fall protection anchor that can be used in wooden or metal framing that spreads the load over a number of framing members, and has fasteners in numerous orientations to spread shear forces.

SUMMARY

Rooftop anchors are often installed to provide workers with fall protection via a personal fall arrest system ("PFAS"). Such anchors can be temporary for use during construction or reroofing, or permanently installed for use when performing rooftop maintenance, inspection and the like. A PFAS connector can be directly connected to an anchor for use around the anchor. Alternatively, a horizontal line (cable, strap, or the like) can be connected to and/or run through two or more anchors, wherein the PFAS connector can be attached to the horizontal line so the worker can operate along the horizontal line for greater mobility.

A fall protection anchor, particularly for use in wood-framed buildings but not limited thereto, is disclosed herein. Rather than being attached to the roof sheathing or a single framing member, the fall protection anchor disclosed herein attaches to multiple surfaces of the rooftop framing. The construction of the fall protection anchor allows it to attach to both horizontal and vertical framing member surfaces, and further allows the fasteners for the fall protection anchor to penetrate the wood at multiple right angles, spreading the shear forces and increasing the strength of the fall protection anchor.

In a first embodiment, the fall protection anchor comprises a square horizontal plate, an anchor connection comprising a vertical post with a top ring mounted in the top center of the horizontal plate, and four vertical plates mounted at right angles to form a square on the bottom of the horizontal plate. The square formed by the vertical plates is smaller than the square of the horizontal plate, so that the horizontal plate may have holes around the edge to accommodate fasteners. Such holes may be countersunk to minimize the protrusion of the fastener head. Likewise, the vertical plates may have a plurality of holes to accommodate fasteners. The vertical post may be round, square, oval, polygonal, or any other suitable shape.

In a typical installation of the fall protection anchor, the rooftop framing is constructed just to accommodate the square formed by the vertical plates. The framing may be double thickness around the square to increase the strength of the anchor, provide the fasteners with sufficient material to penetrate, and spread the load along the framing. In addition, blocking may be extended on either side of the fall protection anchor to spread the load to adjacent framing, and construction strapping may be added to the blocking. Fasteners, such as nails, bolts, lag screws, or other heavy duty screws may be used to fasten the horizontal and vertical plates to the framing. The horizontal plate may be installed above or below the rooftop sheathing. Roofing materials may then be applied to seal the vertical post and prevent water penetration.

The protection anchor may be compliant with appropriate regulations such as OSHA 1926:502 (1995), ANSI Z359.1-07 (2007), or ANSI 2359.1-07 (2014) or other applicable regulations. Typically, a fall protection anchor must be able to withstand a 5,000 pound (2,268 kg) tensile load, to provide adequate protection during a fall. The fall protection anchor disclosed herein has undergone testing, and meets the minimum standards required for fall protection anchors.

Accordingly, it is an object of the present invention to provide an improved fall protection anchor. Other and further objects and advantages will appear hereinafter.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Rooftop safety anchors are used to protect rooftop workers from falls. Anchors can be used as part of a support or suspension system, or may be as an auxiliary fall protection independent of such systems. A PFAS typically comprises a body support (safety harness for the worker), an anchor that is securely fastened to the building structure, and a connector between the anchor and the harness. The present invention focuses on the anchor.

Figure 1:
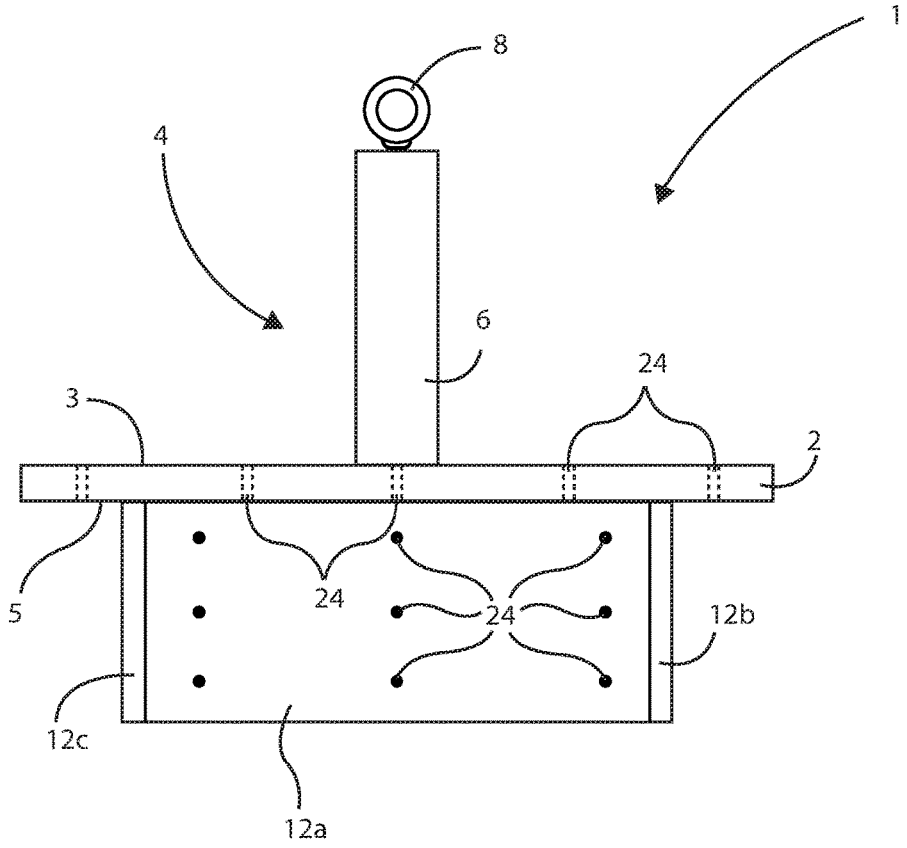
FIG. 1 depicts a side view of the present invention.
Figure 2:
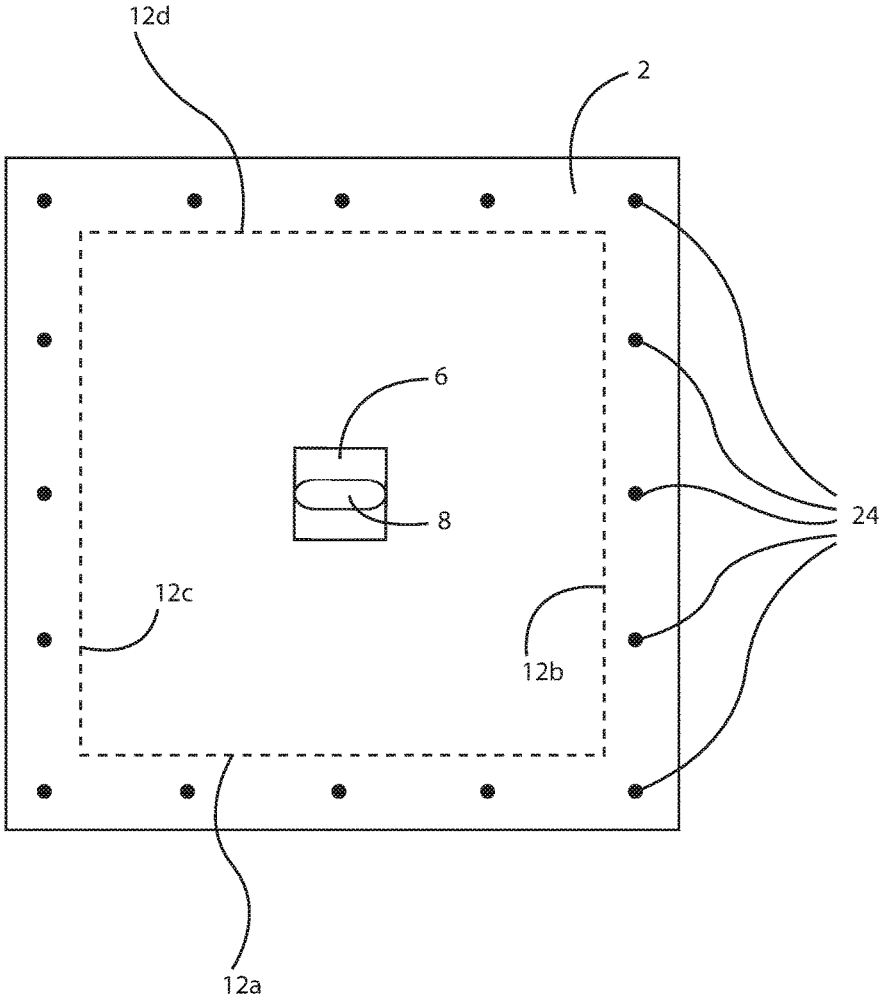
FIG. 2 depicts a top view of the present invention.
Figure 3:
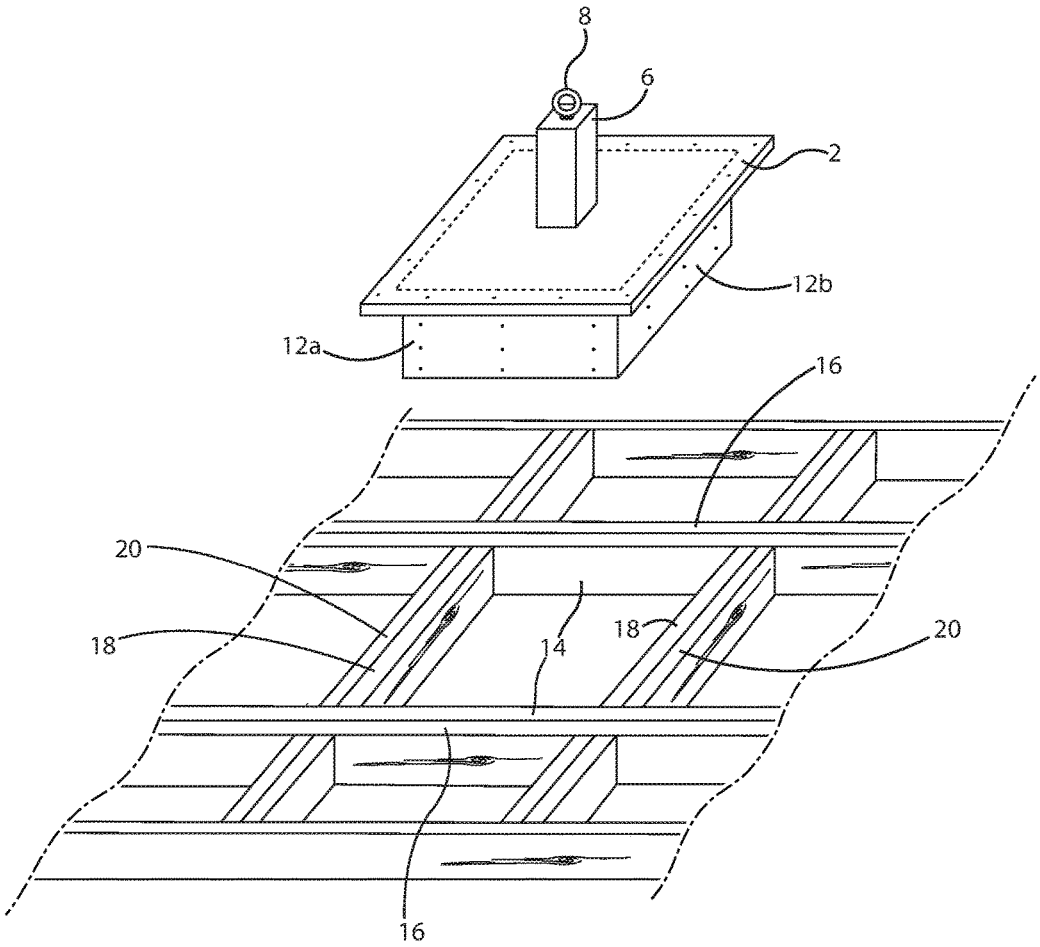
FIG. 3 depicts a perspective view of the present invention before it is placed into framing members.

As shown in FIGS. 1-5, the fall protection anchor 1 disclosed herein may be used for support, suspension, or fall protection. FIGS. 1-3 show that the fall protection anchor 1 may include a horizontal plate 2, which is preferably square or rectangular to correspond to typical building framing. The horizontal plate 2 has a top surface 3 and a bottom surface 5. Coupled with the top surface 3 of the horizontal plate 2, preferably near the middle, is the anchor connection 4, which may comprise a post 6 and/or a connection attachment 8. If a post 6 is used the bottom end is preferably mounted perpendicular to the top of the horizontal plate 2, and may be any suitable length, although a preferred embodiment may have a post length of approximately 16 inches (400 mm). The post 6 may be hollow or solid, and may have any suitable cross section, including but not limited to square, round, oval, or polygonal, and may be constructed of any suitable material that has sufficient strength and durability to survive the elements. In a preferred embodiment, the post 6 may be constructed of 3.5 inch (90 mm) square steel tubing with 0.375 inch (10 mm) wall thickness. In an alternative preferred embodiment, the post 6 may be a cylindrical pipe with a 4-inch outer diameter and a 3.5-inch inner diameter, although other diameters may be used. The post 6 may be coupled with the horizontal plate 2 in any suitable manner, but the preferred attachment method is welding. The preferred material for the post 6 is steel and its alloys, either stainless steel or non-stainless steel coated with anti-corrosion material such as zinc, galvanizing, coatings, or the like. Preferably, if non-stainless steel is used for the horizontal plate 2 and the post 6 and/or connection attachment 8, after the post 6 and/or connection attachment 8 is welded to the horizontal plate 2, the entire assembly or portions of the assembly may be given anti-corrosion treatment. A hole may be located in the plate within the interior of the post 6, or anywhere along the post 6 to relieve pressure during galvanizing or other anti-corrosion treatments.

The connection attachment 8 may be a ring or eyebolt of a suitable diameter to attach or insert a connection device 10 such as a snaphook, carabiner, cable, horizontal lifeline, webbing, etc. The connection attachment 8 may be used without the post 6, coupled with the horizontal plate 2. The connection attachment 8 could be a structure other than a simple ring, such as a D-ring, swivel, a locking clip, or any other suitable attachment. The connection attachment 8 is preferably made of steel, which may be forged or otherwise strengthened or inherently strong enough to withstand significant forces generated during a fall. Alternatively, the connection attachment may be made of any other suitable material that can withstand such forces. In a preferred embodiment, the connection attachment 8 may comprise a 0.5-inch steel plate placed horizontally across the top of the post 6, and welded or otherwise attached to the post 6, with a 4-inch×4-inch square of steel plate with a 2-inch diameter eyelet, welded or otherwise attached vertically to the horizontal steel plate. This 4×4 steel plate may have its top two corners rounded for safety and/or ease of use, but preferably there will be at least a continuous 1-inch annulus of steel plate material bounded by the rounded top corners. Preferably the connection attachment 8 will have anti-corrosive properties or an anti-corrosive finish. Preferably the connection attachment 8 will have a relatively smooth finish to prevent abrasion of the connection device 10. The connection attachment 8 may be coupled with the horizontal plate 2 or the post 6 by any suitable means, including but not limited to welding, adhesives, threaded connections, etc. If a removable coupling is used, such as a threaded connection, it may include some means of preventing accidental loosening, such as a cotter pin, keyway, thread locking adhesive, split-lock, locking nut, lock washers, or even a weld.

Alternatively, the anchor connection 4 may be coupled with the horizontal plate 2 by the connection attachment 8 comprising an eye bolt or equivalent with a long shank (not shown) that can extend through the post 6 and a small hole (not shown) in the horizontal plate 2, wherein the threads of the shank are secured to the bottom surface 5 of the horizontal plate 2 with a nut or other suitable retention element, or the shank could be welded to the horizontal plate 2.

Coupled to the bottom surface 5 of the horizontal plate 2 is at least one vertical member 12. Preferably there are four vertical members 12*a*, 12*b*, 12*c*, and 12*d*, which are substantially planar and preferably rectangular, and may be coupled with the horizontal plate 2 along their length, with each plate perpendicular to the adjacent plates such that they form a rectangle. The ends of the vertical members 12*a*, 12*b*, 12*c*, and 12*d* may be coupled together to close the rectangle, or the ends may be separated by a distance. The vertical members 12*a*, 12*b*, 12*c*, and 12*d* may be constructed of steel, and may be coupled to the horizontal plate 2 by welding. Welding all the short edges of the vertical members 12*a*, 12*b*, 12*c*, and 12*d* together such that they form square or rectangle may strengthen the vertical members. In alternative embodiments, the vertical member(s) 12 may comprise non-planar configurations, such as tubing, bar stock, or the like, and/or non-rectangular configurations of any suitable shape.

Preferably, the horizontal plate 2 is 0.5 inch (13 mm) thick steel plate, and the vertical members 12 are 0.25 inch (6 mm) thick steel plate. Preferably, the horizontal plate 2 is square, 18.5 inches (470 mm) along each side. Preferably, the vertical members are approximately 14.375 inches (365 mm) long and 7.25 inches (185 mm) wide, so that the square formed by four vertical members 12*a*, 12*b*, 12*c*, and 12*d* is 14.375 inches (365 mm) along each side, and extend generally perpendicularly 7.25 inches below the bottom surface 5 of the horizontal plate 2. In such an embodiment the bottom surface 5 of the horizontal plate extends approximately 2.0 inches (50 mm) beyond the sides of the square formed by the vertical members 12*a*, 12*b*, 12*c*, and 12*d*. The thicknesses and dimensions of the plates may be thicker or thinner than stated above, and the thickness ratio between the horizontal plate 2 and the vertical member(s) 12 of 2:1 may be different as well. Suitable materials other than steel may also be used for their construction. In some embodiments, any number of vertical members 12 may be used, including but not limited to one, two, three, or four vertical members.

Figure 4:
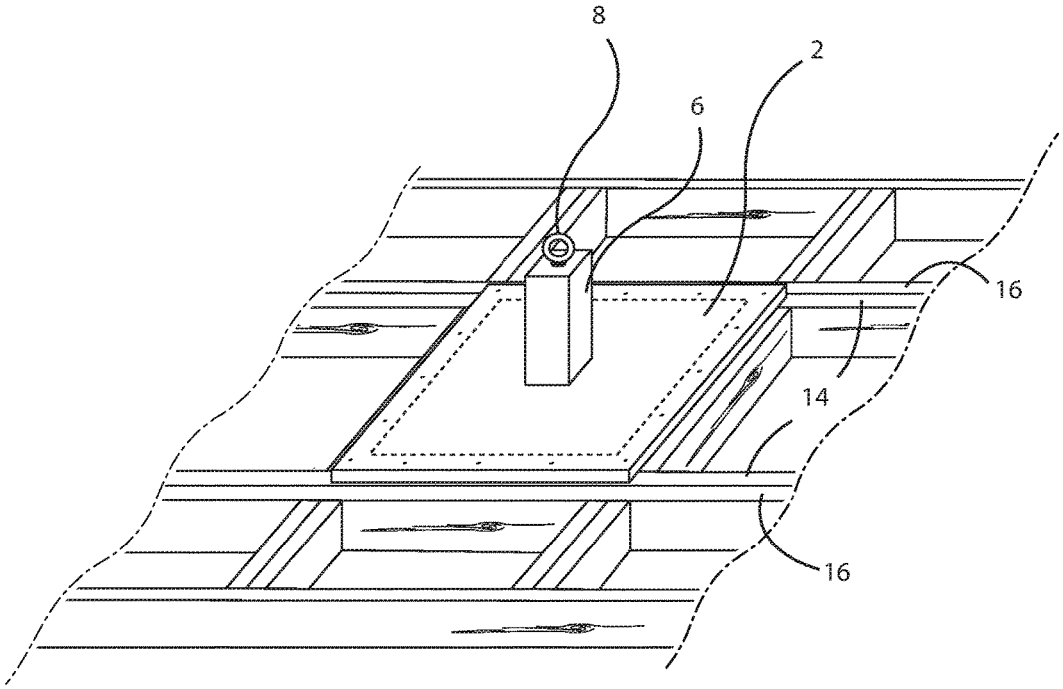
FIG. 4 depicts a perspective view of the present invention after it is placed into framing members.

As shown in FIGS. 3-4, the fall protection anchor 1 may be designed to fit within standard wooden rooftop framing that is spaced 16 inches (405 mm) on center. Such spacing results in a framing opening that is typically 14.5 inches (368 mm) wide, which will accommodate the 14.375 inches (365 mm) square formed by the vertical members 12*a*, 12*b*, 12*c*, and 12*d* with a minimum of play.

In a typical installation, the roof framing is constructed of long timbers 14 (joists, rafters, purlins, etc.) in at least one direction, with typical lumber dimensions of 2×8, 2×10, 2×12, etc. or the metric equivalent. Preferably, where the fall protection anchor 1 is to be installed, the framing will comprise two first long timbers 14 that are spaced 16 inches (405 mm) on center to provide a 14.5 inch opening. On the outsides of each of the first long timbers 14 there may be a second long timber 16 so that there is a double thickness of the long timber on each side while maintaining the 14.5 inch opening. Two first blockings 18, the same lumber dimension as the long timbers 14, 16 (2×8, 2×10, 2×12, etc.) may be installed perpendicular to the first long timbers 14 to form a 14.5 inch square (rectangle) of substantially horizontal framing members. Then two second blockings 20 may be placed on the outside of each of the first blockings 18, to achieve a double thickness of blocking. Alternatively, double thickness long timber and/or blocking may be used (4×8, 4×10, 4×12, etc.). The double thickness may provide added strength to the installation, although in some applications a double thickness of long timber and/or blocking may not be required to achieve the necessary strength. The blocking 18, 20 is installed with typical framing fasteners 22 such as nails or screws, although heavy duty construction fasteners may be used, as well as brackets or hangers suitable for the task. The framing opening for the fall protection anchor 1 may be atop or adjacent to a wall on the floor below, to provide additional support for the framing supporting the fall protection anchor 1. Preferably the fasteners 22 will penetrate at least 75 percent of the total thickness of the double thickness of long timber and/or blocking, although more or less penetration could be used, including 100 percent penetration for through-bolt fasteners.

The double thickness of long timbers may be continued for approximately 72 inches (1830 mm) or other suitable distance on the sides of each of the first long timbers 14. Likewise, as shown in FIG. 3, the blocking and/or double blocking may be continued onto nearby horizontal framing, which should provide additional strength to the installation by spreading the load among more framing members. Above and/or below the blocking, a continuous piece of construction strapping (Simpson CS/CMST or the like) (not shown) may be installed with appropriate fasteners 22, which may also add strength to the blocking and the overall installation.

In the case of truss framing, or other framing where the long timbers are spaced wider than 16 inches on center, the horizontal plate 2 and the vertical members 12*a*, 12*b*, 12*c*, and 12*d* may be enlarged to accommodate such framing. Alternatively, additional timbers (not shown) may be placed inboard of one or more long timbers until the opening is 14.5 inches wide to accommodate the above-described embodiment of the fall protection anchor 1. Suitable structural fasteners and/or adhesives should be used to secure the additional timbers to the framing. Blocking, double or single, may be placed between the additional timbers to form a 14.5-inch opening for the fall protection anchor 1. Above and/or below the blocking, a continuous piece of construction strapping (Simpson CS/CMST or the like) (not shown) may be installed with appropriate fasteners 22, which may also add strength to the blocking and the overall installation.

Figure 5:
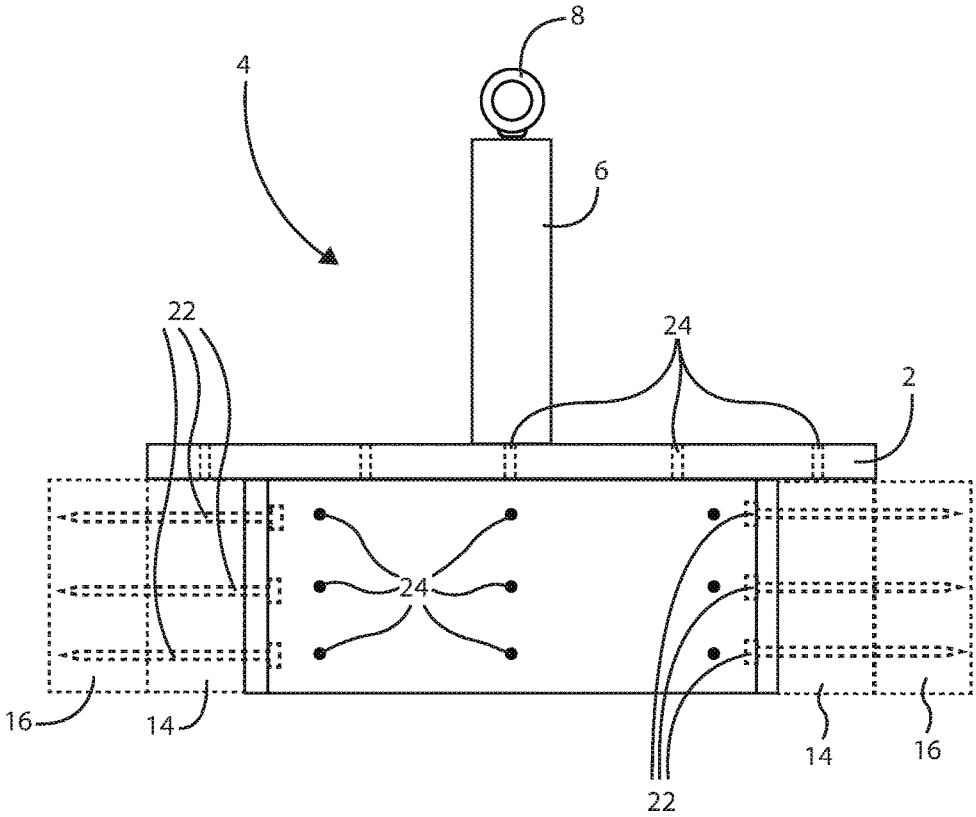
FIG. 5 depicts a side cut-away view of the present invention installed into the framing members.

As shown in FIGS. 1 and 5, in a preferred embodiment, the horizontal plate 2 and/or the vertical members 12*a*, 12*b*, 12*c*, and 12*d* are equipped with holes 24 to accommodate fasteners 22. The fasteners are typically driven through the holes 24 and into the framing, and the head of the fastener 22 holds the plates securely to the framing 14 and 18, and/or 16 and 20. The fasteners 22 may be nails, screws, bolts and nuts, lag screws, or other suitable fasteners for attaching structural steel to wooden or steel framing. If screws are used in wood framing, they may be heavy duty construction screws, such as Simpson SDS, USP WS, or the like. Preferably, the fasteners 22 will be of sufficient length so that when placed in the vertical members 12 they will penetrate both the first and second long timber 14, 16 and blocking 18, 20. Alternatively, the fasteners 22 may only need to be long enough and/or thick enough to provide the necessary strength for the application.

The holes 24 in the horizontal plate 2 accommodate fasteners 22 to resist shear and tension uplift. The horizontal plate 2 sets on top of the framing 14, 16, 18, 20 to provide compression for the fall protection anchor 1. Both tension and compression forces allow the fall protection anchor 1 to work properly. The vertical members 12*a*, 12*b*, 12*c*, and 12*d*, below the horizontal plate 2 also work in shear, tension and compression. These components working together allow the fall protection anchor 1 to minimize movement at the connection attachment 8 atop the post 6. The connection attachment 8 should have sufficient tensile and shear strength to resist a load of at least 5000 lbs. applied at any angle to the connection attachment, as required by 29 C.F.R. Section 1926.502(d), as well as other applicable regulations.

In a preferred embodiment, to accommodate the fasteners 22, there may be sixteen holes 24 in the horizontal plate, approximately 0.3125 inches (8 mm) in diameter, evenly spaced around the perimeter, approximately halfway between the edges of the horizontal plate 2 and the vertical members 12, although they could be spaced such that the fasteners 22 penetrate the approximate center of the framing members surrounding the vertical members 12. In a preferred embodiment, there may be six or nine similarly sized holes 24 in each of the vertical members 12*a*, 12*b*, 12*c*, and 12*d*, which may be arranged in two or three vertical rows per vertical member, where the end rows are spaced approximately 2.0 inches (50 mm) from the ends of the vertical member, and the three holes 24 in each vertical row are spaced 2.0, 4.0, and 6.0 inches from the bottom surface 5 of the horizontal plate. Alternatively, the holes 24 in the vertical members 12 may be arranged in other manners, such as a singular or repeating "W" or "X" pattern, or in other patterns so that the fasteners 22 of the horizontal plate 2 do not interfere with the fasteners 22 of the vertical members 12*a*, 12*b*, 12*c*, and 12*d*, but are far enough from the edges of both the vertical members and the framing members to provide sufficient strength for each. The fasteners 22 may have a shank thickness that is approximately 0.25 inches (6 mm) to fit within the holes 24. More or less holes 24 and fasteners 22 may be used, and the holes 24 and fasteners 22 may be larger or smaller. Between the horizontal plate 2 and the vertical members 12*a*, 12*b*, 12*c*, and 12*d*, multiple fasteners are oriented in the x, y, and z axes, which improves both their shear strength and resistance to pull out. Even if only one vertical member 12*a* is used, it still provides attachment holes 24 for fasteners 22 that are oriented perpendicular to the fasteners 22 of the horizontal plate 2, spreading the forces beyond what is possible from just using fasteners and/or plates in a single orientation. If two adjacent vertical members 12*a* and 12*b* are used, then there will be fasteners 22 in all three axes. The number of fasteners and their spacing also distributes the load to several framing members. The additional blocking beyond the opening for the fall protection anchor 1 distributes the load to the long timbers that are outboard of the opening that accommodates the vertical members 12.

In addition to or in lieu of the above-described attachment holes 24, larger attachment holes (not shown) may be provided to accommodate large through bolts as fasteners 22. In a preferred embodiment, two such larger attachment holes may be on each vertical member 12 located 1.5 inches above the bottom and 3 inches from the vertical side of each vertical member 12, for a total of eight total larger attachment holes per fall protection anchor 1. These larger attachment holes may be 15/16 (0.9375) inches in diameter, to accommodate a 7/8 (0.875) inch bolt fastener 22. Such bolts may be placed through the long timbers of the framing, for a total of four bolts per fall protection anchor 1, although bolts may also or alternatively be used in the blocking. Such bolts may be secured with suitable nuts and washers. In alternative embodiments, there may be more or less larger attachment holes and corresponding bolt fasteners, and the positions of the attachment holes 24 may vary. For example, it may be suitable to just use one large bolt fastener 24 centered in each vertical member 12.

Although the preferred embodiment includes multiple attachment holes 24 in the horizontal plate 2 and the vertical members 12, alternative embodiments may have fewer or even no attachment holes 24 in the horizontal plate 2 or the vertical members 12. For example, it may be sufficient to use only one fastener 22 (or multiple fasteners 22) in each vertical member, and no fasteners in the horizontal plate 2. Alternatively, it may be sufficient to use only a few fasteners 22 in the horizontal plate and no fasteners 22 in the vertical members. Although testing (discussed below) shows that using multiple fasteners 22 in both the horizontal plate 2, the vertical members 12, the long timbers 14, 16, and blocking 18, 20, results in a structure that did not fail under mandated loads, further testing may show that fewer or no fasteners 22 in all these structures may still provide the required strength. Testing may further show that blocking 18, 20, is not required for the requisite strength.

Although the preferred embodiments of the fall protection anchor 1 attach the vertical members to the inside surfaces of the horizontal framing 14, 16, 18, 20, alternative embodiments could attach to the outside surfaces of the horizontal framing so that the vertical members 12 essentially surround the horizontal framing rather than sitting inside of it. This would allow workers to attach the fall protection anchor 1 to the horizontal framing from above or the side, rather than having to insert fasteners 22 from underneath. Although the edges of the vertical members could not be connected to each other in such configuration (the corners would have to be open to accommodate the framing members), such embodiments may be helpful where underside access is limited, such as retrofitting. Such configurations could have one, two, three, four, or more vertical members 12.

In a preferred embodiment, the holes 24 in the horizontal plate 2 may be countersunk or otherwise opened to accommodate the head of the fastener 22, so that the heads are either flush with or protrude minimally above the top surface 3 of the horizontal plate 2, while maintaining sufficient strength of the horizontal plate 2. This will help maintain a relatively smooth surface on the horizontal plate 2 for either the roof sheathing or the roofing membrane.

Because the horizontal plate 2 is preferably installed directly over the framing, the roof sheathing may be installed around the horizontal plate 2. Given that the preferred thickness of the horizontal plate 2 is 0.5 inches, and typical roof sheathing is 5/8 inch (16 mm) or 3/4 inch (18 mm) plywood or the like, the horizontal plate 2 will be close to flush with the roof sheathing. This will ease the installation of the roofing materials. If desired, a thin sheet of plywood, such as 1/4 inch (6 mm), could be used to cover the horizontal plate 2 and aide the smooth transition for the roofing material, while covering the heads of the fasteners 22.

Alternatively, the horizontal plate 2 may be installed above or below the roof sheathing. To reduce the stress on roof sheathing or roofing membrane placed atop the right-angle edges of the horizontal plate 2, the edges of the horizontal plate 2 may be rounded or tapered to ease the transition, and may even be extended with a tapering edge. Alternatively, a tapered edge could be installed adjacent to the horizontal plate, made of wood, plastic, metal or any other suitable material.

Alternatively, rather than countersinking the holes in the horizontal plate 2, a transition cover (not shown) could be used to cover and/or approximate the height of the heads of the fasteners 22 so that the transition cover provides a generally smooth and substantially continuous surface above the horizontal plate 2 and its fasteners 22, and may also provide an edge transition for the horizontal plate 2. Such a transition cover may allow the horizontal plate 2 to be thinner due to the lack of countersinking, which would reduce cost of the horizontal plate 2 both in material cost (thinner plate is cheaper) and machining cost (for the countersinking). The transition cover could be single or multiple pieces, and used above or below the roof sheathing. As a non-limiting example of such a transition cover, if the thickness of the heads of the fasteners 22 and the horizontal plate 2 are both 0.25 inches (6.35 mm), a top cover in the same shape as the horizontal plate could be fashioned from 0.25 inch plywood with holes cut out to accommodate the fastener heads and the post 6. One or more pieces of material that match up to the combined height of the plate and the top cover (0.25+0.25=0.5 inches) could be placed against the edge of the horizontal plate 2 and taper outwardly from the horizontal plate 2.

On a flat roof installation, the anchor connection 4 may penetrate the roofing membrane. The penetration may be sealed by conventional methods, such as flashing, sealants, etc.

Alternatively, the fall protection anchor 1 need not be installed solely on flat rooftops. It may also be employed on the side of a building, on sloped surfaces including but not limited to roofs, or even on ceilings or overhangs. The framing and fasteners must be sufficient to accommodate such placement. For such alternative installations, the construction of the fall protection anchor 1 could be different, such as having both the post 6 and the vertical members 12 attached to the bottom surface 5 of the horizontal plate 2. For such installations, the "top" and "bottom" surfaces of the horizontal plate 2 would merely refer to opposite sides, and not necessarily the direction the surface is facing.

A prototype of the fall protection anchor 1 was tested to make sure it conformed to the regulatory requirements and design parameters. The prototype comprise a 18.5-inch square horizontal plate 2 and a 3.5-inch square post 6 that was 16 inches tall and ⅜-inch wall thickness, with a forged eye bolt as a connection attachment 8, and four vertical members 12*a*, 12*b*, 12*c*, and 12*d*, 0.25 inches thick. The horizontal plate 2 had 16 attachment holes 24 on the top at the outside edges. The four vertical members 12*a*, 12*b*, 12*c*, and 12*d*, had nine holes (three on each end and three at the center of each skirt). The horizontal plate 2, vertical members 12*a*, 12*b*, 12*c*, and 12*d*, and tube steel post 6 were ASTM A36 material. The vertical members 12*a*, 12*b*, 12*c*, and 12*d*, and tube steel post 6 were welded to the ½-in. thick horizontal plate 2 (all welds were a minimum of ⅛-in. beads). One 10,000 pound tension proof load and four 5,000 pound lateral proof loads were tested, with the force applied at the eye bolt.

The test equipment utilized in the test program consisted of a loading system, a load cell, displacement instruments, and test fixtures. The loading system consisted of an Enerpac hydraulic ram and hand pump. The load cell was a Sensotec 75,000-lbs. capacity compression load cell. The displacement instruments consisted of digital indicators that had been calibrated within four months of the testing. The test fixtures connected the test equipment to the eye-bolt. The fall protection anchor 1 was mounted into a test rig comprising two 6×10 long timbers and two 4×10 blocking timbers attached with Simpson HUS410 hangers. The fall protection anchor 1 was attached to these timbers with Simpson SDS ¼"×3" wood screws, 16 screws in the horizontal plate 2, and 24 screws in the vertical members 12*a*, 12*b*, 12*c*, and 12*d* (six screws per member, with three at each lateral edge).

The 5,000-pound lateral proof load was applied in 500-pound increments. The proof load was held for a duration of 3-minutes. Displacement readings were recorded at each load increment, after achieving the proof load and after the load hold duration of 3-minutes was achieved. All four directions were separately tested, and all four tests resulted in no observed failure of the fall protection device 1. The largest measured displacement occurred from the horizontal bending of the post 6, with displacements at the top of the post ranging from 0.766-0.957 inches at the end of the max load period, and 0.250-0.458 inches when the load was released. The post 6 torsion displacement (uplift) measured at the top of the post ranged from 0.313-0.444 inches at the end of the max load period, and 0.110-0.191 inches when the load was released. The horizontal plate 2 tension displacement (uplift) measured from 0.031-0.094 inches at the end of the max load period, and 0.021-0.033 inches when the load was released. The horizontal plate 2 compression displacement (downward) measured from 0.096-0.154 inches at the end of the max load period, and 0.030-0.051 inches when the load was released.

The 10,000-pound tension proof load was applied in 1,000-pound increments. The proof load was held for a duration of 3-minutes. Displacement readings were recorded at each load increment, after achieving the proof load and after the load hold duration of 3-minutes was achieved. Once again, the test resulted in no observed failure of the fall protection device 1. The displacement measured at the top of the post 6 ranged from 0.109 inches at the end of the max load period, and 0.013 inches when the load was released. The horizontal plate tension displacement (uplift), measured from 0.066 inches at the end of the max load period, and 0.005 inches when the load was released.

A method of constructing the fall protection anchor 1 disclosed herein may comprise providing a horizontal plate with a top and bottom surface, at least one vertical member, and an anchor connection, coupling the anchor connection with the top surface of the horizontal plate, and welding at least one vertical member perpendicularly to the bottom surface of the horizontal plate, wherein the vertical and horizontal plates have holes to accommodate fasteners.

A method for installing the fall protection anchor 1 disclosed herein may comprise providing fall protection device comprising a horizontal plate with a top and bottom surface, an anchor connection coupled with the top surface of the horizontal plate, and at least one vertical member perpendicularly coupled with the bottom surface of the horizontal plate, wherein both the horizontal plate and vertical member(s) have holes to accommodate fasteners, providing an opening in a building framing to accommodate the vertical member(s) in close relation, installing fasteners through the holes of the horizontal or vertical members and into the framing. A method of using such an installed fall protection anchor 1 may comprise coupling a connection device 10 to the anchor connection 4, and coupling the connection device 10 to a body support of a worker.

The foregoing fall protection anchor is not limited to installation in wood-framed buildings. The fall protection anchor 1 may be adapted to metal-framed buildings as well. Fasteners would have to be suitable for use on metal framing, or wooden framing would have to be attached to the metal framing to install the fall protection anchor 1 as discussed above.

The foregoing description of the preferred embodiment of the invention has been presented for the purposes of illustration and description. It is not intended to be exhaustive or to limit the invention to the precise form disclosed. Modifications and variations are possible in light of the above teaching. It is intended that the scope of the invention not be limited by this detailed description, but by the claims and the equivalents to the claims appended hereto.

What is claimed is:

1. A fall protection anchor for a wood-framed building, comprising:

a plate comprising a first surface, a second surface opposite the first surface, and a perimeter;

a post comprising a first end and a second end, the first end coupled with the first surface of the plate, the second end having a connection attachment, and the post oriented substantially perpendicular to the plate and located substantially centrally on the first surface of the plate; and a first member and a second member, each of the first and second members being substantially planar with a plurality of edges, and each of the first and second members coupled substantially perpendicularly with the second surface of the plate, wherein one of the plurality of edges of each of the first and second members is in direct contact with the second surface of the plate, each of the first and second members spaced inwardly relative to the perimeter of the plate, each of the first and second members defining an attachment hole.

2. The fall protection anchor of claim 1, further comprising a third member and a fourth member, each of the third and fourth members being substantially planar with a plurality of edges, each of the third and fourth members coupled substantially perpendicularly along one of the plurality of edges with the second surface of the plate.

3. The fall protection anchor of claim 2, wherein the first member, the second member, the third member, and the fourth member are arranged to form a box-like configuration.

4. The fall protection anchor of claim 3, wherein the plate further defines a second set of attachment holes adjacent to the perimeter of the plate.

5. The fall protection anchor of claim 4, wherein the second set of attachment holes are located between the perimeter of the plate and the box-like configuration of members.

6. A fall protection anchor for a wood-framed building, comprising:

a plate being substantially rectangular and comprising a top and a bottom, and defining attachment holes spaced inwardly from and along at least a portion of a perimeter of the plate;

a connection attachment, coupled with the top of the plate;

a first member being substantially planar with a first set of four edges; and a second member being substantially planar with a second set of four edges, wherein the first member is coupled along one of the first set of edges with the bottom of the plate, wherein the first member is in direct contact with the bottom of the plate, the second member is coupled along one of the second set of edges with the bottom of the plate, wherein the second member is in direct contact with the bottom of the plate, wherein the first member and the second member are spaced inwardly from the attachment holes of the plate, wherein the first and second members are coupled with each other along one of each of the edges of the first and second sets of edges of the first and second members, the first member and the second member each defining an attachment hole.

7. The fall protection anchor of claim 6, further comprising a third member and a fourth member, each of the third and fourth members having a third and fourth set of four edges, respectively, the third and fourth members each defining an attachment hole, wherein one of the edges in the third set of edges is coupled with the bottom of the horizontal plate and one of the edges in the fourth set of edges is coupled with the bottom of the horizontal plate.

8. The fall protection anchor of claim 7, wherein the second and third members are coupled with and perpendicular to each other along respective edges of the edges of the second and third members, the third and fourth members are coupled with and perpendicular to each other along respective edges of the edges of the third and fourth members, and the fourth and first members are coupled with and perpendicular to each other along respective edges of the edges of the fourth and first members.

9. The fall protection anchor of claim 8, wherein the attachment holes of the plate are located between the first member, the second member, the third member, and the fourth member and the perimeter of the plate.

10. The fall protection anchor of claim 9, wherein the connection attachment is coupled with the plate by a post.

11. A fall protection anchor for a wood-framed building, comprising:

a rectangular plate comprising a first set of four edges, a first surface, and a second surface opposite the first surface, the first set of four edges defining a perimeter of the rectangular plate;

a post comprising a first end and a second end, the first end coupled with the first surface of the rectangular plate and located substantially centrally thereon, the second end having a connection attachment, and the post oriented substantially perpendicular to the rectangular plate;

four members, each of the four members being substantially planar and rectangular with a second set of four edges, and each of the four members coupled substantially perpendicularly along one of the second set of edges with the second surface of the rectangular plate and coupled along two of the second set of edges with the other members to form a rectangular box of members on the second surface of the rectangular plate, said box of members spaced inwardly from the perimeter of the rectangular plate, wherein each of the four members defines an attachment hole configured to accept a fastener, wherein the rectangular plate further defines a second set of attachment holes, each configured to accept a fastener.

12. The fall protection anchor for a wood-framed building of claim 11, wherein the rectangular plate further defines a second set of attachment holes, each configured to accept a fastener, wherein the second set of attachment holes are located around the perimeter of the four edges of the rectangular plate, between the four edges of the rectangular plate and the box of members.

* * * * *